US008979662B2

(12) United States Patent
Rogers et al.

(10) Patent No.: US 8,979,662 B2
(45) Date of Patent: Mar. 17, 2015

(54) POWERED PERSONAL SWING DEVICE

(71) Applicants: Griselda Rogers, Brooklyn, NY (US); Louis Rogers, Brooklyn, NY (US)

(72) Inventors: Griselda Rogers, Brooklyn, NY (US); Louis Rogers, Brooklyn, NY (US)

( * ) Notice: Subject to any disclaimer, the term of this patent is extended or adjusted under 35 U.S.C. 154(b) by 40 days.

(21) Appl. No.: 13/887,676

(22) Filed: May 6, 2013

(65) Prior Publication Data

US 2013/0310187 A1 Nov. 21, 2013

Related U.S. Application Data

(60) Provisional application No. 61/649,652, filed on May 21, 2012.

(51) Int. Cl.
*A63G 9/16* (2006.01)

(52) U.S. Cl.
CPC ..... *A63G 9/16* (2013.01)
USPC ..... 472/119

(58) Field of Classification Search
CPC ..... A63G 9/16
USPC ..... 472/119
See application file for complete search history.

(56) References Cited

U.S. PATENT DOCUMENTS

| | | | | |
|---|---|---|---|---|
| 2,371,384 | A * | 3/1945 | Dyer, Jr. | 472/120 |
| 4,805,902 | A * | 2/1989 | Casagrande | 472/119 |
| 5,833,545 | A * | 11/1998 | Pinch et al. | 472/119 |
| 6,254,490 | B1 * | 7/2001 | Lawson et al. | 472/119 |
| 7,789,762 | B2 * | 9/2010 | Greger et al. | 472/119 |
| 7,883,426 | B2 | 2/2011 | Bellows et al. | |

* cited by examiner

*Primary Examiner* — Michael Dennis
(74) *Attorney, Agent, or Firm* — Daniel Boudwin; Global Intellectual Property Agency LLC

(57) ABSTRACT

A powered swing device is provided that imparts a swinging motion onto the chains of a child's swing set. The device comprises an upper cross member and a pair of rotatable swing arm members extending downward therefrom along the ends of the cross member. The ends of the cross member secure to the swing chain by way of outward post members that fit through opposing open chain links of the swing chain. Each of the swing arm members include a lower outward post member to attach through a chain link below the cross member. An internal electric motor drives the swing arm members in a reciprocal motion, while the upper and lower post members impart the motion onto the swing chain. The speed of the swing arms is controllable, while a radio is provided for further entertainment purposes. Overall, the device allows for swinging a child without adult assistance.

8 Claims, 4 Drawing Sheets

POWERED PERSONAL SWING DEVICE

CROSS REFERENCE TO RELATED APPLICATION

This application claims the benefit of U.S. Provisional Application No. 61/649,652 filed on May 21, 2012, entitled "Swing to Go." The above identified patent application is herein incorporated by reference in its entirety to provide continuity of disclosure.

BACKGROUND OF THE INVENTION

1. Field of the Invention

The present invention relates to swing and child motion devices for entertainment purposes. More specifically, the present invention provides a device for attaching to a playground swing to impart a continuous swinging motion thereon for child enjoyment independent of adult assistance.

Children greatly enjoy using swing devices in outdoor playgrounds and in other child oriented entertainment spaces. Swings are suspended seats from an overhead support that allow a child to swing therefrom while positioned within the seat. These devices are well known in the art as entertainment devices and are commonly found in parks and playgrounds. For particularly young children, however, the act of initiating and continuing the swinging motion can be difficult, as their legs may be too short to reach the ground and their skills at shifting their body weight may not be fully developed. Consequently, adult supervision is required to assist in the swinging motion, both in the initiation and continuance thereof.

This activity requires consistent attention from an adult, who oversees the child in the swing set and imparts the swinging motion thereon from behind the seated child. It can become tiring for a parent or guardian to push the child in the swing for long periods of time. This becomes even more tiring when the parent is attentive to multiple children or when the children request to be pushed on swings at identical times. Furthermore, if the parent were to leave a swinging child unattended to care for another, the child may become upset or even injured if they unsuccessfully tried to swing themselves.

Automated swinging devices have been available in the art and are generally categorized into two types: the first being a swinging device that is typically designed to be a stand-alone structure with a base unit, swing motor, and a detachable seat, and the second type being a motorized device that is semi-permanently installed on patio furniture or the like to impart swinging and rocking motions. These devices are large and require significant effort to install, and furthermore are not compliant with existing swing sets.

Neither of these devices can be effectively and efficiently attached to a playground swing to impart a swinging motion thereon, wherein the device attaches to an existing swing set. The present invention relates to a device that attaches to the swing chain, swing wire, or swing rope that is pivotably attached to the swing overhead support. The device attaches thereto and imparts a continuous fore-aft motion that rocks the swing seat back and forth. The device initiates and continuously imparts motion on the swing chain such that the child can swing independent of immediate adult assistance and without any child input. The device comprises a top section that houses a battery-operated drive motor, which is connected to a pair of pivoting arms. The pivoting arms include swing chain attachment means that affix to the swing chain (or chain equivalent) such that the pivoting arms impart a swinging motion on the swing chain as the motor is energized. Once the unit is secured to the swing chain, the speed of the swinging motion can be controlled by a speed selector knob while in operation.

2. Description of the Prior Art

Devices have been disclosed in the prior art that relate to automatic child motion and swinging devices. These include devices that have been patented and published in patent application publications, and generally relate to the user being placed or seated into a larger apparatus, which is then used to swing the user in various manners and orientations using its own swing structure. The following is a list of devices deemed most relevant to the present disclosure that are described for the purposes of highlighting and differentiating the unique aspects of the present invention and further highlighting the drawbacks existing in the prior art.

Specifically, U.S. Pat. No. 6,254,490 to Lawson describes an automated swinging device that is installed in ceiling joists and can be modified to be installed in conventional freestanding swings. The device includes a rectangular base frame that supports a main shaft that attaches to a conventional porch swing or the like. The device uses a conventional motor used to drive an automatic rocking system with no additional effort by the user. The device also uses a threaded rod to mechanically adjust the depth of the swing. While the device provides a useful automated swing for multi-user porch swings, the Lawson device suffers from being bulky and heavy, difficult and expensive to install, and would require the device to be installed near a conventional source of residential power. The structure of the present invention is one of a portable and rapidly securable assembly attachable to playground swing sets or similar support structures.

U.S. Pat. No. 5,833,545 to Pinch describes an automated child swinging device that has a battery operated swing motor to periodically swing a seat frame, which attaches to a removable seat. The device has a control system for periodically actuating the swing motor in order to adaptively adjust to the natural frequency and period of the seat. In order to use the device, the user first pulls (or pushes) the seat to the appropriate height, which activates the control system and swing motor that will maintain its swinging motion at the predetermined frequency and period. While providing a unique adaptive motor control system, the structure of the Pinch device is a single and complete child motion assembly and is not adaptable or attachable to existing playground swings.

U.S. Pat. No. 7,789,762 to Greger describes a child motion device that includes a frame and swing assembly that can be mounted on a variety of surfaces. The device has a system that drives a swing assembly, which includes a pair of swing arms having proximal and distal ends. The distance between the proximal ends is adjustable, which is used to adjust one of the motion characteristics. The device has a swing assembly with unique motion characteristics capable of imparting a swinging motion, gliding motion, and in one embodiment, a bouncing motion. The device employs different modes of operation (motion, speed, music, and sound) to sooth or entertain the child as the device is in use. Similar to the Pinch device, the structure of the Greger device is not attachable to existing swings.

U.S. Pat. No. 4,805,902 to Casagrande describes an infant swing with a base frame, legs, and a coil-spring motor. The device has a seat that is connected to a carriage. The carriage is connected to the motor in order to impart an oscillating motion onto the seat to sooth the infant while an adult can perform other activities. The seat is removable and can be used as an infant carrier or car seat. While providing a soothing motion, the structure of the Casagrande device is not portable such that it can attach to existing swings.

None of the prior art devices provide the benefits inherent in the present invention or suggest a structure that is operably attachable to an existing swing set chain for imparting a reciprocal motion onto the swing for child entertainment. There is a clear need in the art for a new and useful automatic swinging device that can be utilized in conjunction with existing swing sets and the like, wherein the device is designed for portability, flexibility with regard to application, and ease of deployment. This present invention allows parents and caretakers to entertain multiple children without being dedicated to a single child on a swing. Therefore, it is clear that there is a need in the art for an improvement to existing automated swing devices. In this regard, the instant invention substantially fulfills these needs.

SUMMARY OF THE INVENTION

In view of the foregoing disadvantages inherent in the known types of child swing devices now present in the prior art, the present invention provides a new powered swing device that can be utilized for providing convenience for the user when swinging multiple children on an existing swing set.

It is therefore an object of the present invention to provide a new and improved powered swing device that has all of the advantages of the prior art and none of the disadvantages.

It is another object of the present invention to provide a powered swing device that is attachable to an existing swing set having a pair of swing chains, whereby the device imparts a reciprocal swigging motion onto the swing chain.

Another object of the present invention to provide a powered swing device having a motorized structure that imparts continuous, reciprocal motion onto a swing.

Yet another object of the present invention to provide a powered swing device that allows for a child to be swung within a swing without adult assistance, whereby the device imparts the swinging motion and the adult can watch over the child or attend to other children.

Another object of the present invention to provide a powered swing device that is attachable to different styles of swing set chains, whereby the chain may be comprised of a plurality of individual chain links or be comprised of a continuous material such as a swing strap.

Another object of the present invention to provide a powered swing device that includes an audio device that projects entertaining sounds or music for child enjoyment while swinging.

A final object of the present invention to provide a powered swing device that includes a control system to regulate the swing arm speed and power.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
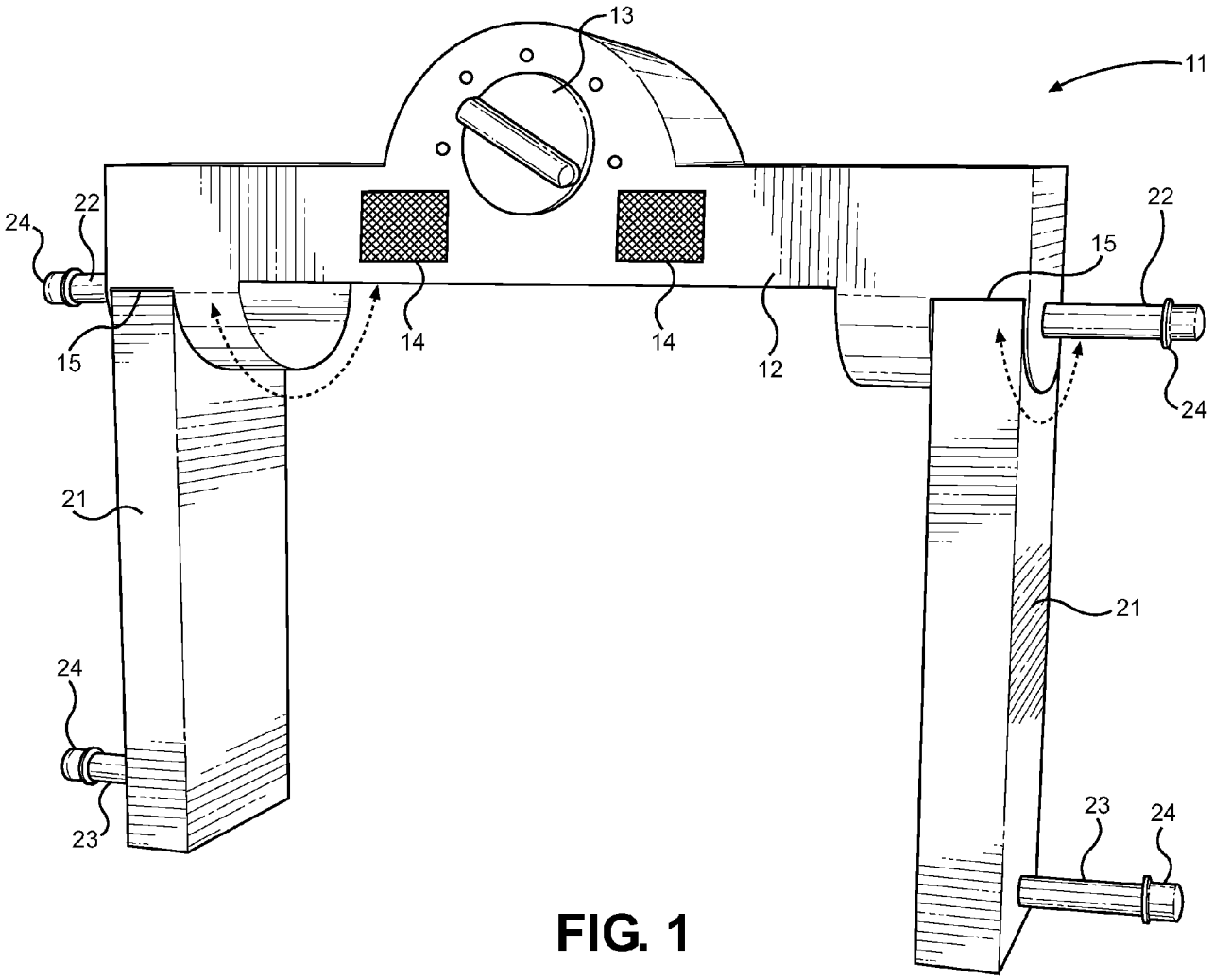
FIG. 1 shows a frontal perspective view of an exemplary embodiment of the present invention.

Reference is made herein to the attached drawings. Like reference numerals are used throughout the drawings to depict like or similar elements of the powered swing device. For the purposes of presenting a brief and clear description of the present invention, the preferred embodiment will be discussed as used for attaching to an existing swing set chain and for imparting a swinging motion thereon for child enjoyment. The figures are intended for representative purposes only and should not be considered to be limiting in any respect.

Referring now to FIG. 1, there is shown a frontal perspective view of powered swing device 11 of the present invention. The device comprises an upper cross member 12 that comprises an elongated housing having an internal volume and opposing ends 15 that support downward directed swing arm members 21. When deployed, the cross member is adapted to be positioned horizontally between the swing chains of a swing set. Within the interior of the cross member 12 and adjacent to its ends 15 is at least one electric motor and a connection to the swing arm members 21. The swing arm members 21 are rotatably attached to the cross member 12, wherein the electric motor imparts a reciprocal motion thereto. The reciprocal motion is utilized to impart a back and forth swinging motion onto the swing chain, wherein each of the swing chains is given the same swing direction to either initiate or maintain a swinging motion.

The device 11 is an independent structure that is readily attachable to an existing swing set, whereby the ends of the device have a first and second connection point to impart a moment onto the opposing chain lengths. The moment is imparted in a reciprocal and gradual fashion to allow the elongated length of the chain below the device to react to the imparted motion. The motion must allow the swing chair to extend to its zenith along its swing path before imparting a return motion, thereby ensuring a smooth swinging motion and eliminating any jerkiness or awkward transitions between swing directions.

To attach the device to an existing swing chain, the preferred embodiment includes a set of opposing upper posts 22 and a set of opposing lower posts 23 that extend outward from the device and secure through chain links adjacent to the device ends. In this way, the device 11 can be placed between opposing swing chains and positioned in a level orientation while in operation. As the swing arms 21 move through their reciprocal path, the lower posts 23 force the chain to move therewith, while the upper posts 22 work to maintain an offset between the upper and lower chain for creating a swing arc for the swing seat therebelow. To ensure the posts do not dislodge from the swing chain, end caps 24 may be connected onto the posts that prevent the post ends from freely sliding through the chain link opening. Therefore, to mount and dismount the device, the post end caps 24 must be removed.

Figure 2:
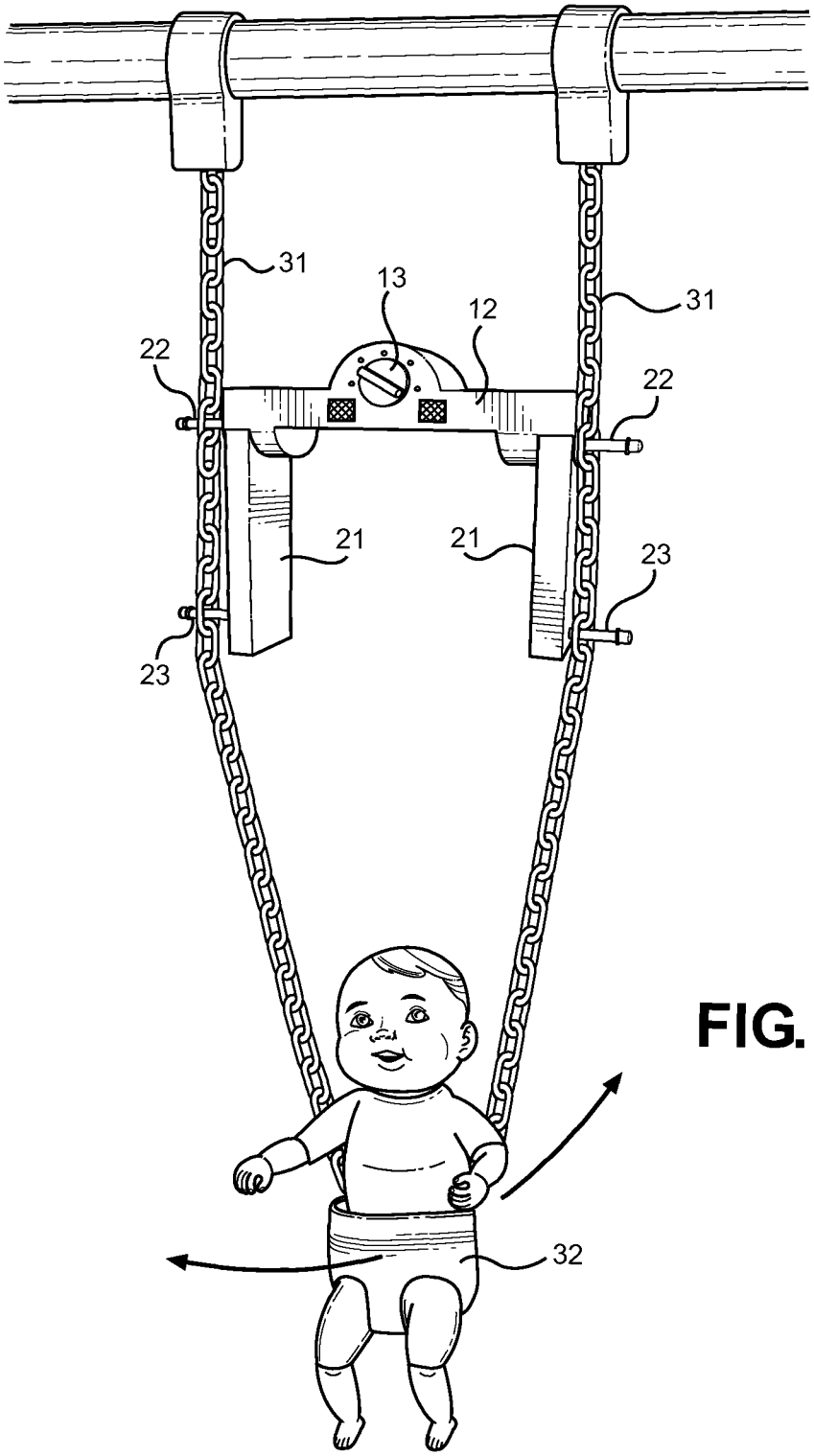
FIG. 2 shows a view of the present invention in a working state, imparting a reciprocal motion onto a child's swing set while a child is in the swing seat.

Referring now to FIGS. 1 and 2, the speed of the swinging arm motion and thus the speed with which the child swing seat 32 moves is controlled by a control circuit that includes a speed selector knob 13 along a portion of the device cross member 12. The knob 13 allows a parent to choose the speed and intensity of the swinging motion, wherein the speed and power of the input, and thus the speed and height of the swing seat 32 is controllable. Once the upper 22 and lower 23 posts are placed within the swing chain 31, the speed can be set and the device can initiate the swinging motion.

In an alternate embodiment, the speed can also be controlled by a remote control device, which allows a parent to control the speed without interrupting the swinging motion. This embodiment requires a remote control, an interface for receiving signals from the remote control (IR sensor, etc.), and further requires the control circuit to understand the incoming remote control signals. Preferably, however, if the parent wishes to change the swinging speed, he or she can make inputs using the selector knob 13 while the device is in motion or by first seizing the child seat 32 to momentarily end the swinging motion for adjustment thereto.

Therefore, it is clear that the present invention provides soft, reciprocal input that is suitable and safe for child use. The device is not designed to impart large swinging motions that would place the child in jeopardy or swing the child too high on the swing set. Rather, the device provides a subtle motion that can initiate and continue a swinging motion suitable for a young child. A further safety device may include a timer switch, which deactivates the swinging motion after several minutes, whereafter the device can be reactivated. This prevents the child from being left alone and swung continuously without regard to the child's welfare. As a default, the safety timer will cease the child motion and allow the child to sit peacefully in the swing until a parent attends to him or allow the child to exit therefrom by himself if capable.

Along the cross member 12 is further provided at least one speaker 14 and an audio device that drives the speakers 14. The speakers can play songs or soothing tones for child entertainment purposes, wherein the child can listen to songs while enjoying the swinging motion. All electrical components for the speakers 14 and the audio system are housed within the cross member 12 interior, including the speaker wiring, amplifiers, and a sound source such as a hard drive audio source. Input may be provided along the cross member for the user to select songs or tunes from the sound source while in operation. Further provided within the cross member 12 interior is a battery power source, which powers the electric motor or motors and the audio system. The batteries may be removable for replacement or alternatively a power input may be provided for recharging the batteries without removing the same from within the cross member 12.

Figure 3:
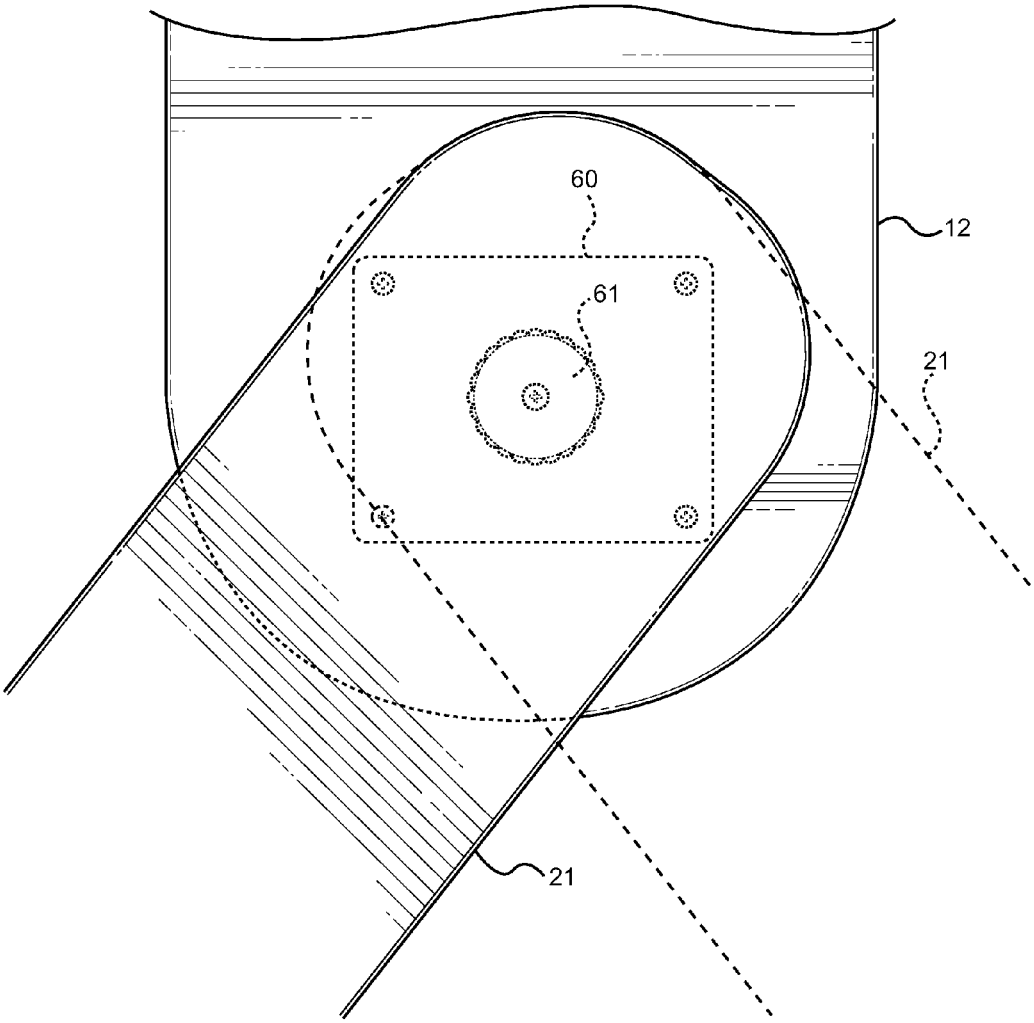
FIG. 3 shows an end view of an embodiment of the present invention, whereby an electric motor directly drives the swing arms.

Referring now to FIG. 3, there is shown an end view of an embodiment of the motive input for the present invention, wherein a stepper motor 60 imparts a reciprocal input onto the swing arms 21 along an arc length for swinging the swing chair from the ends of the cross member 12. The stepper motor 60 connects to the swing arm 21 by way of a motor output shaft 61, which is preferably splined to impart the rotation of the motor onto the pivot point of the swing arm 21. The use of a stepper motor 60 does not require the motor output shaft 61 to make a full rotation, wherein the motion of the shaft 61 can be accurately controlled along a pathway defined by a portion of a full rotation thereof. The motor 60 requires a control circuit that operates its shaft 61 positioning and its speed and power.

Figure 4:
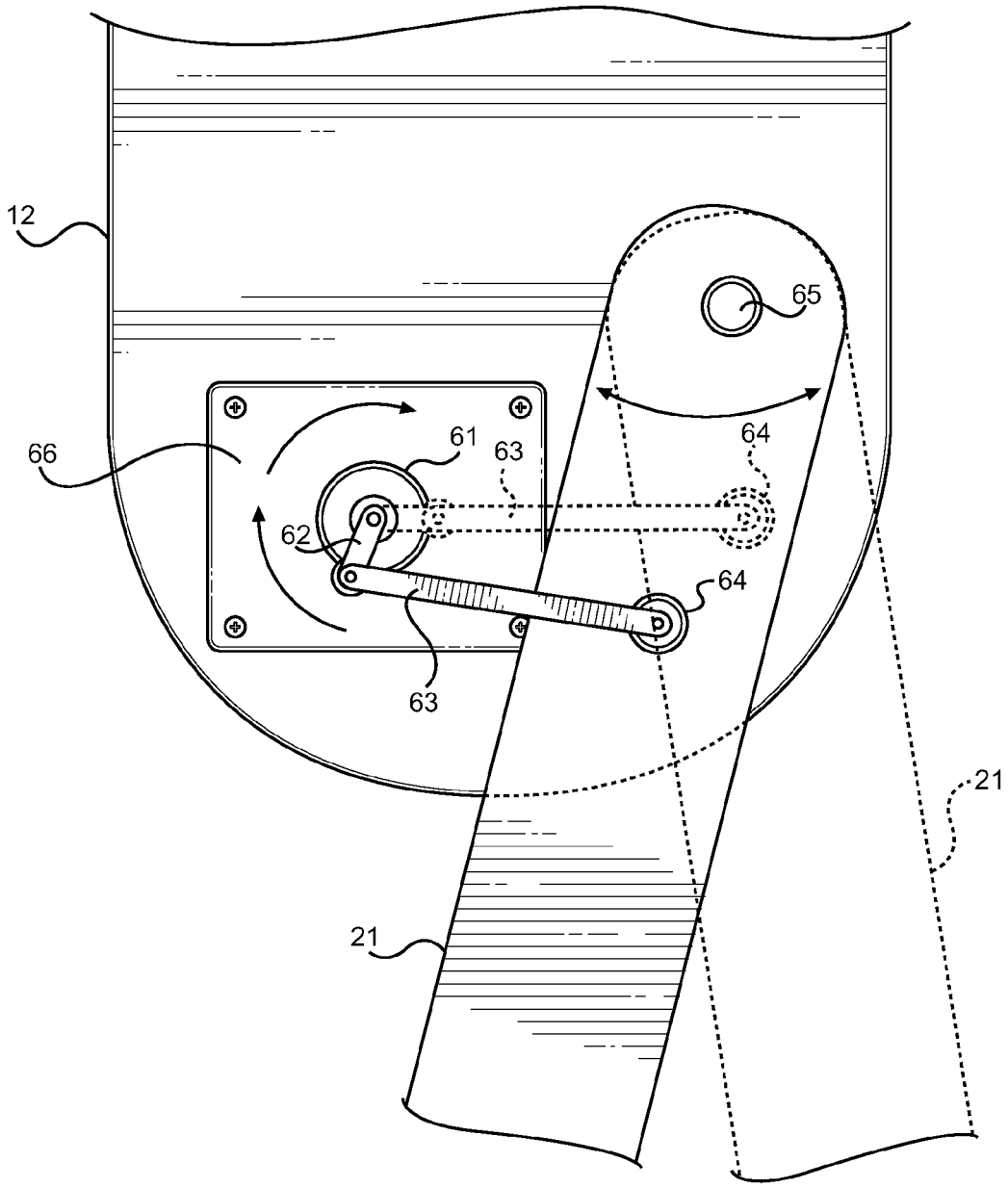
FIG. 4 shows an end view of another embodiment of the present invention, whereby an electric motor drives a linkage that drives the swing arms.

Referring now to FIG. 4, there is shown an alternate embodiment of the motive input for the device swing arms 21. In this embodiment, an electric motor 66 is provided in connection with a linkage assembly to drive the swing arm 21 in a reciprocal motion while the electric motor output shaft 61 continuously rotates. This embodiment contemplates an offset shaft 62 that connects directly to the motor output shaft and rotates in a circular path. The outer end of the offset shaft 62 rotatably connects to a link 63 that further rotatably connects 64 to the swing arm at a given distance with regard to its pivot point 65. In this way, the offset shaft 62, the link 63, the offset between connection, 64 and the swing arm pivot point 65 establish an effective four-bar linkage that is in a Grashof condition. This allows the offset shaft 62 to rotate fully through its motion while the connection 64 with the swing arm 21 travels an arc-length path.

It is not desired to limit the present invention to a specific type of motive input or electrical layout, but rather it is desired to disclose a new and novel swinging device that is attachable to an existing swing set for powered input thereto. The type and number of electric motors, the associated linkages, and the electrical connections may take on several different designs, falling within the scope of the present disclosure. The structural attachment means between the swing chain and the device may likewise be updated to accommodate different swing chain types and materials. The most common of these is the chain link assembly, however the posts of the present invention may be replaced with clamps or other suitable connects for unitary strap material or tubular material that may not present a through-hole as provided by the chain link assembly. Overall, the device is adapted to impart a reciprocal motion onto an existing swing chain, whereby its speed and intensity is controllable, and the device requires no modification of the existing swing for connection thereto.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A powered swing device attachable to an existing swing, comprising: a cross member comprising an elongated housing having an internal volume and opposing ends; a first and second swing arm member rotatably attached to said cross member ends to form a U-shape; a first and second upper swing chain attachment means extending from said cross member ends; a first and second lower swing chain attachment means extending from said swing member; said attachment means adapted to connect to opposing swing chains to position said cross member therebetween; at least one electric motor within said cross member interior for driving said swing arm members in a reciprocal path to swing said swing chain; a control circuit for controlling said electric motor operation; a power source; wherein said chain attachment means further comprises an elongated post member adapted to fit through the open interior of a chain link of a swing chain; and wherein said elongated post members further comprise an end cap that attaches to a distal end thereof for preventing said post from separating from said chain link.

2. The device of claim 1, further comprising a speed selector knob that connects to said control circuit for controlling said electric motor output.

3. The device of claim 1, further comprising an audio system within said cross member for projecting sounds therefrom, said audio system comprising speakers, an amplifier, a sound source, and associated wiring connection to said power source.

4. The device of claim 1, further a timer for ceasing power to said electric motor after a period of use.

5. The device of claim 1, wherein said chain attachment means further comprises a clamp means for securing around a strap or rounded swing chain.

6. The device of claim 1, wherein said at least one motor comprises:

a first and second stepper motor, said stepper motor having an output shaft connect to said swing arm members;

said stepper motors pivoting said swing arm members along an arc-length path.

7. The device of claim 1, further comprising:

a linkage assembly connected between said electric motor output shaft and a swing arm member;

said electric motor capable of full rotation while said swing arm member travels an arc-length path.

8. The device of claim 7, wherein said linkage assembly further comprises an offset shaft connected to said electric motor output shaft and a link between said offset shaft and a connection point on said swing arm member.

* * * * *